US012789073B2

(12) United States Patent
Parikh et al.

(10) Patent No.: US 12,789,073 B2
(45) Date of Patent: Nov. 10, 2026

(54) VISUAL TARGET ASSISTED WORKOUT DEVICE

(71) Applicant: HYPERLAB SPORTECH PRIVATE LIMITED, Gandhinagar (IN)

(72) Inventors: Hitarth Parikh, Ahmedabad (IN); Christopher Richard, Chennai (IN); Neel Mehta, Ahmedabad (IN)

(73) Assignee: HYPERLAB SPORTECH PRIVATE LIMITED, Gandhinagar (IN)

( * ) Notice: Subject to any disclaimer, the term of this patent is extended or adjusted under 35 U.S.C. 154(b) by 196 days.

(21) Appl. No.: 18/724,502

(22) PCT Filed: Dec. 19, 2022

(86) PCT No.: PCT/IN2022/051098
§ 371 (c)(1),
(2) Date: Jun. 26, 2024

(87) PCT Pub. No.: WO2023/131968
PCT Pub. Date: Jul. 13, 2023

(65) Prior Publication Data

US 2025/0065213 A1 Feb. 27, 2025

(30) Foreign Application Priority Data

Jan. 8, 2022 (IN) ..... 202221001096

(51) Int. Cl.
*A63B 71/06* (2006.01)
*A63B 24/00* (2006.01)

(52) U.S. Cl.
CPC ..... *A63B 71/0622* (2013.01); *A63B 24/0062* (2013.01); *A63B 2024/0068* (2013.01);
(Continued)

(58) Field of Classification Search
CPC .... H04N 9/3173; H04N 9/3176; G09G 3/002; A63B 71/0622; A63B 2024/0081; G09B 19/0038
See application file for complete search history.

(56) References Cited

U.S. PATENT DOCUMENTS 6,430,997 B1 8/2002 French et al. ..... 73/379.04
9,304,379 B1 * 4/2016 Wang ..... G03B 21/2053
(Continued)

FOREIGN PATENT DOCUMENTS

IN 202221001096 A 11/2022

OTHER PUBLICATIONS

International Search Report mailed Apr. 28, 2023, issued to International Application No. PCT/IN2022/051098.

*Primary Examiner* — Robert J Utama
(74) *Attorney, Agent, or Firm* — Kevin J Fournier Intellectual Property Legal Services Ltd.; Kevin J Fournier

(57) ABSTRACT

The present invention (101) relates to the field of Interactive Exercise machines. In particular, the present invention (101) provides a visual target assisted workout device that can be used either indoors or outdoors. The present invention (101) projects an image as a visual target for the user to run towards and determines the position of the user during the course of workout. The present invention (101) also calculates the distance travelled 10 by the user during the workout and the time taken to travel that distance and thereby, allowing the user to compute their acceleration, velocity, stamina and reflexes.

5 Claims, 2 Drawing Sheets

(52) U.S. Cl.
CPC ..... *A63B 2220/20* (2013.01); *A63B 2220/805* (2013.01); *A63B 2220/806* (2013.01); *A63B 2220/833* (2013.01); *A63B 2225/50* (2013.01); *A63B 2225/74* (2020.08)

(56) References Cited

U.S. PATENT DOCUMENTS

| | | | | |
|---|---|---|---|---|
| 10,583,328 | B2 * | 3/2020 | Aragones | G16H 50/30 |
| 2011/0172060 | A1 | 7/2011 | Morales et al. | 482/8 |
| 2011/0222064 | A1 | 9/2011 | Umeda et al. | 356/445 |
| 2016/0191868 | A1 | 6/2016 | Fujiune | H04N 9/315 |
| 2017/0030705 | A1 | 2/2017 | Bridges | G01B 11/03 |
| 2018/0174347 | A1 * | 6/2018 | Chaney | G09G 5/377 |
| 2022/0074716 | A1 | 3/2022 | Chia | F41J 9/14 |

* cited by examiner

VISUAL TARGET ASSISTED WORKOUT DEVICE

CROSS-REFERENCE TO RELATED APPLICATIONS

This application is a national stage of International Application No. PCT/IN2022/051098, filed Dec. 19, 2022, which claims the benefit of Indian Application No. 202221001096, filed Jan. 8, 2022, in the Indian Patent Office, the disclosures of which are incorporated herein by reference.

FIELD OF INVENTION

The present invention relates to the field of interactive workout devices. The present invention provides a visual target assisted workout device. Moreover, the present invention also provides a visual target assisted workout device that projects an image as visual targets and can be used either indoors or outdoors.

BACKGROUND OF INVENTION

During the present era of busy and stressful lifestyle, many people turn towards aerobic exercises to maintain their physical and mental fitness. Exercise is one of the important parts of lifestyle modification. Exercise is known to reduce weight gain, obesity, muscle mass maintenance, reduce fatigue, boosts cardiovascular system, improves lung health, improve energy levels, and can help prevent or reduce certain chronic health conditions. Exercise also improves mental health by reducing anxiety, depression, and negative mood and by improving self-esteem and cognitive function. Moreover, exercise can provide antioxidant protection, can delay the sign of aging, helps brain health and boosts memory.

Daily physical workout is also important for the athletes and sportsperson to practice their daily drills and improve themselves. Many a times, users prefer to own certain equipment or register themselves for the online classes for their daily workouts. Multiple Gymnasium facilities are also available where the laymen/athletes can get proper equipment and can train with the help of professional trainers. However, these methods can get tedious or boring after a while and reduce the consistency of the users. They always face a constant need to stimulate their mind and body through creative and innovative forms of exercise. Therefore, it is easier to make exercise a regular part of lifestyle if you enjoy/have fun doing it. Moreover, the athletes cannot get the detailed report and analysis (SWOT analysis) of their skills such as agility, reflexes and stamina while working out on their own or in the gymnasium.

Although different types of interactive machines are available in the market, most of them fail to specifically interact with the users in real-time in the manner of providing visual targets and making the machine user-friendly. Many of conventionally available machines prefer physical targets like cones and pods which decreases the flexibility of target positions and number of drills. Some of the conventionally available interactive exercise machines also use additional lenses and wall projectors to project the targets which ultimately makes them more expensive.

Therefore, there is a need to provide an interactive exercise machine that interacts with the user in real-time in the manner of providing visual targets, can be used by a layman or an athlete for a target assisted workout wherein the targets are the image projected by a light source instead of the physical targets, without the need of a lens or wall projector and thereby, making it affordable and compact.

Prior Arts and its Disadvantages

A US patent application U.S. Pat. No. 6,430,997B110 discloses a system and method for tracking and assessing movement skills in multidimensional space. The invention provides an accurate stimulation of sports to quantify and train performance constructs by employing sensing electronics for determining, in essentially real time, the player's three-dimensional positional changes in three or more degrees of freedom (three dimensions); and computer-controlled sport specific cuing that evokes or prompts sport specific responses from the player that are measured to provide meaningful indicia of performance. The sport specific cuing is characterized as a virtual opponent that is responsive to, and interactive with, the player in real time. The virtual opponent continually delivers and/or responds to stimuli to create realistic movement challenges for the player.

However, the invention does not provide a machine that provides visual targets to the user and determines the position of the user and track their movements. This invention also fails to eliminate the need of a projecting screen or a wall to project the laser target. In addition, this invention fails to capture the form of the user while performing the workout.

Another such US patent application US2022074716A1 provides a target system that can detect the location of a projectile disposed within a target and subsequently alter an image being displayed on the target in response to the location of the detected projectile. The target system can include a sensor, an image source, a portable electronic device, and a computing device. The sensor can be positioned on the target to detect the location of the projectile on a face of the target. The image source can project an image onto the face of the target. The portable electronic device can receive input from a user to dictate the image(s) displayed on the target. The computing device can be communicatively coupled to the sensor, the image source, and the portable electronic device and cause the target system to detect the location of the projectile and subsequently alter the image displayed on the target in response to the location.

Although the invention described here mentions the image being displayed as a target, it fails to provide a visual target to the user without the need of a projecting screen or a wall. This invention also fails to provide an interactive exercise machine that determines and track the position of the user. In addition, this invention also fails to provide an interactive exercise machine that analyzes the agility and reflexes of the athletes and provide them with their detailed skill analysis report.

Disadvantages of Prior Arts

Existing technologies used for a visual target assisted workout device suffers from all or at least any of the below mentioned disadvantages:

- The conventionally available machines fail to provide a visual target assisted workout device.
- Most of the prior arts fail to provide a visual target assisted workout device that projects visual targets for the user.
- Most of the prior arts fail to provide a visual target assisted workout device that projects a visual target for the user without the need of any projecting screen or wall.

Most of the prior arts fail to provide a visual target assisted workout device that determines and tracks the distance of the user in real-time.

Many of the prior arts fail to provide a visual target assisted workout device that interacts with the user in real-time and accordingly project the consecutive visual targets.

Many of the prior arts fail to provide a visual target assisted workout device that allows the user to compute the acceleration and velocity of the user during the course of workout.

Many of the prior arts fail to provide a visual target assisted workout device that captures the form of the user during the course of workout.

Many of the prior arts fail to provide a visual target assisted workout device that analyze the agility and reflexes of the users and provide them with their detailed skill analysis report.

Many of the prior arts fail to provide a visual target assisted workout device that ensures the correctness of the form and techniques of the users during the workout.

Many of the prior arts fail to provide a visual target assisted workout device that can be connected to any smart devices and is therefore, user friendly.

Many of the prior arts fail to provide a visual target assisted workout device that are compact and portable and can be carried anywhere.

Many of the prior arts fail to provide a visual target assisted workout device that are cost-efficient.

Thus, there is an unmet need to develop an invention that suffices the purpose of providing a visual target assisted workout device and more particularly, a visual target assisted workout device that can be used either indoors or outdoors as it eliminates the need of a projecting screen or a wall.

OBJECTS OF THE INVENTION

Accordingly, the object of the present invention is to provide a visual target assisted workout device. In an aspect the present invention provides a visual target assisted workout device that can be used either indoors or outdoors.

It is another object of the present invention to provide a visual target assisted workout device that projects a visual target for the users.

In yet another object, the present invention provides a visual target assisted workout device that determines and tracks the position of the user in real-time with reference to the location of said visual target assisted workout device.

In yet another object, the present invention provides a visual target assisted workout device that tracks the position of the user to provide the consecutive visual target and thereby, interacts with the user in real-time.

In yet another object, the present invention provides a visual target assisted workout device that analyzes the skills of the user in real-time by computing the acceleration, velocity, agility and reflexes of the user during the workout.

It is yet another object that the present invention provides a visual target assisted workout device that captures/records the form of the user while performing the workout.

It is yet another object that the present invention provides a visual target assisted workout device that ensures the correctness of the form and techniques of the users during the workout.

It is yet another object of the present invention to provide a visual target assisted workout device that can be configured to any smart devices to control the operation of said visual target assisted workout device. Thus, it is an object of the present invention to provide a visual target associated workout device that is user-friendly.

It is yet another object of the present invention to provide a visual target assisted workout device that is cost-efficient by eliminating the need of additional lenses to project the target.

It is yet another object of the present invention to provide a visual target assisted workout device that is compact, portable and can be carried anywhere.

BRIEF DESCRIPTION OF DRAWINGS

| | |
|---|---|
|

Figure 1:
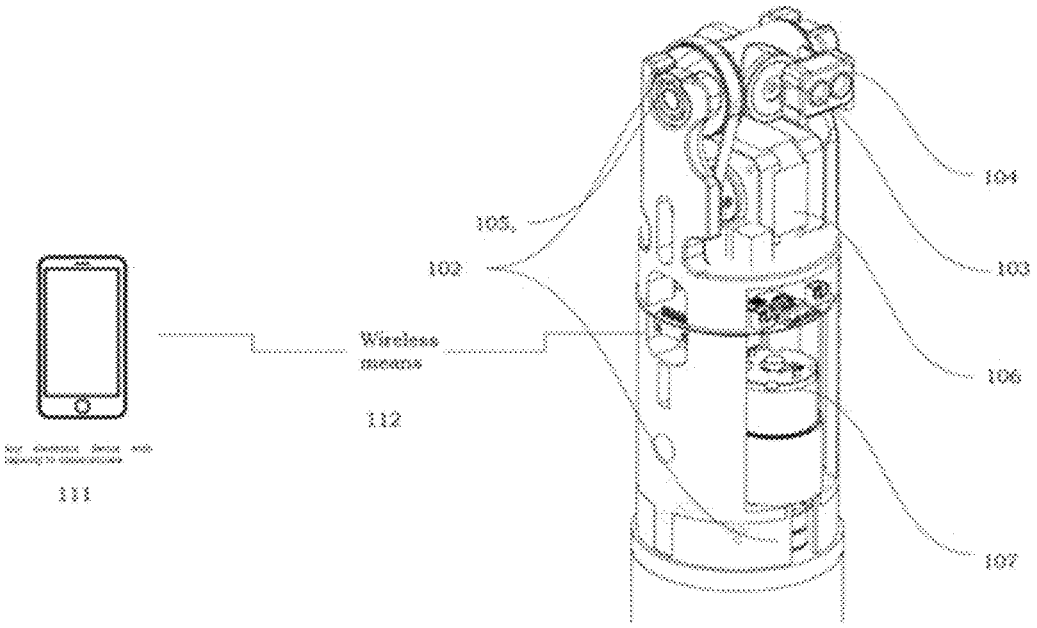
FIG. 1: | Shows the operation of the present visual target assisted workout device in accordance with the user. |
|

REFERENCE NUMERALS OF SAID COMPONENT PARTS OF THE PRESENT VISUAL TARGET ASSISTED WORKOUT DEVICE

101: Present Visual target assisted workout device
102: Projection means
103: Light source
104: Sensor
105: Holder
106: Motor X
107: Motor Y
108: Support structure
109: Controller
110: Storage means
111: Input means
112: Wireless means
113: Power Source
114: Video capturing means
115: Processing means

SUMMARY OF THE INVENTION

The present invention relates to an interactive exercise machine and provides a visual target assisted workout device. The present invention projects an image as a visual target for the user. The target is projected without the limitation of the orientation of the surface and therefore, the present device can be used either indoors or outdoors without the need of a projecting surface. The present invention also determines the position of user in real-time, measures the distance travelled by the user during the course of workout and the time taken to travel that distance and therefore, computes the velocity, acceleration, reflexes, and stamina of the user. Moreover, the present invention facilitates the provision to record the form of the user throughout the workout, compares it to the previously recorded video and thus, ensures the accuracy in the form of the user during the workout. The present invention thereby, provides a visual target associated workout device that is simple, user-friendly, cost-effective, compact and portable.

DESCRIPTION OF THE INVENTION

The present invention provides a visual target associated workout device. The present invention provides a visual target associated workout device that can used either indoors or outdoors. Further, the present invention of a visual target associated workout device is a simple, user-friendly, cost-efficient, compact and portable device. The present invention therefore, provides a technically advanced and substantially efficient solution to the problems of prior art.

Figure 2:
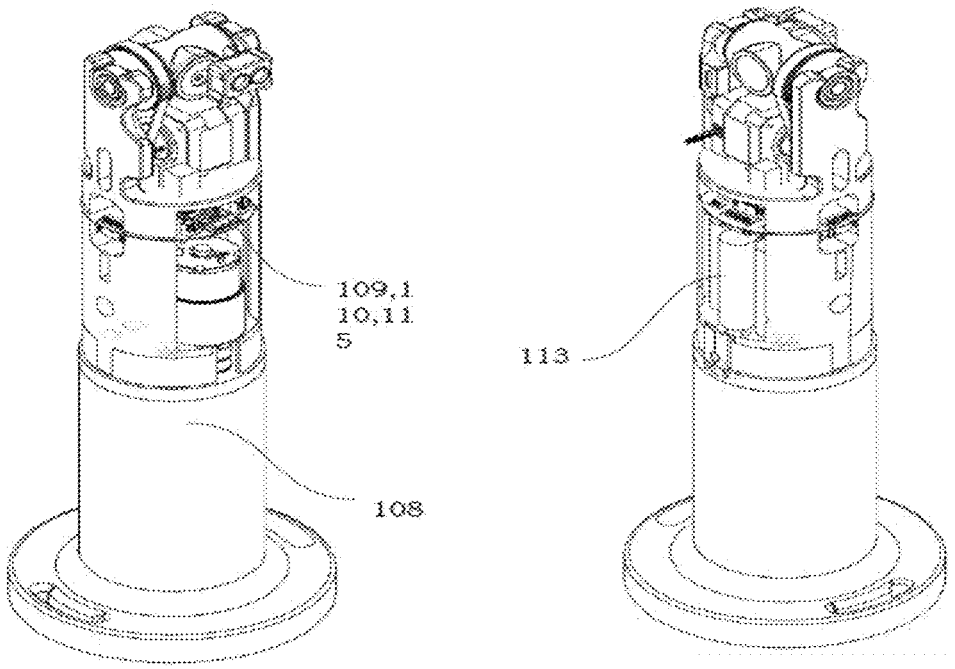
FIG. 2: | Shows the schematic view of the projection means used in the present visual target assisted workout device. |
|
Figure 3:
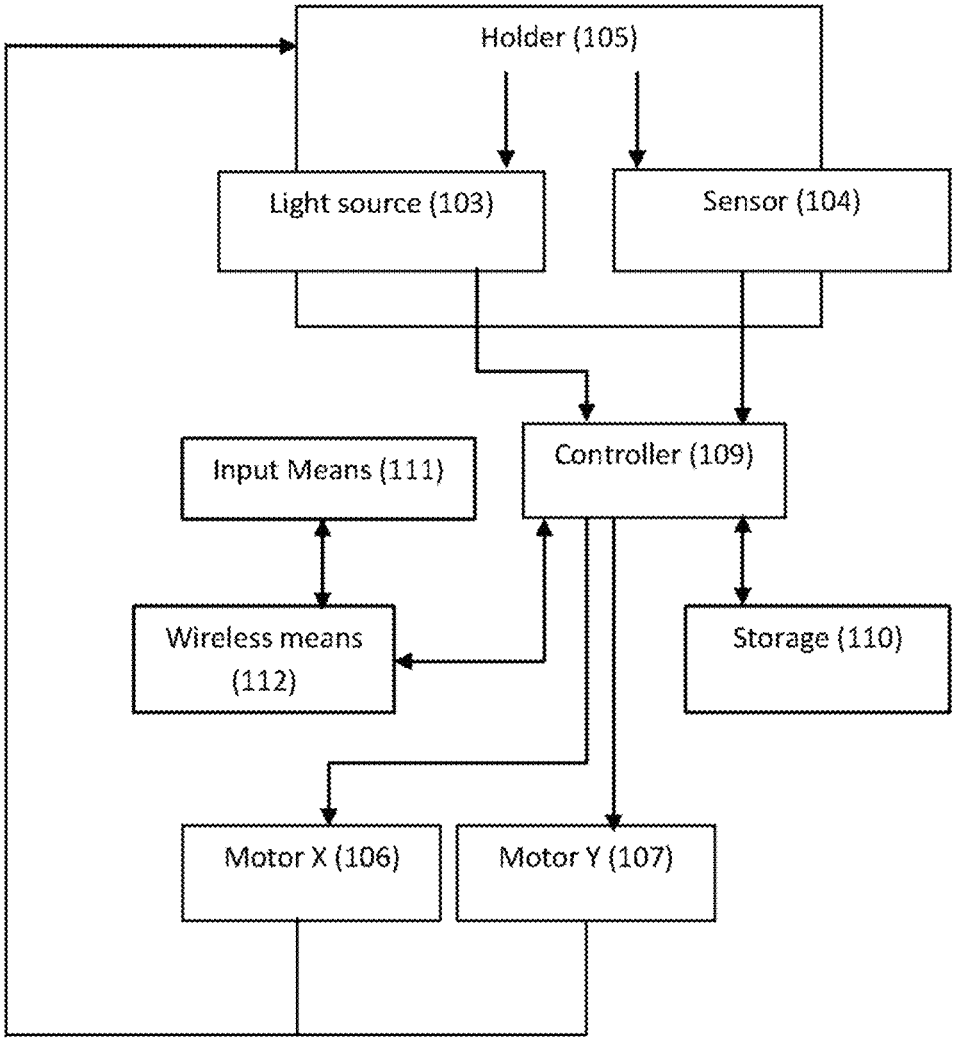
FIG. 3: | Shows the block diagram depicting the working of the present visual target assisted workout device. |

Referring to the FIG. 1-3, the present invention (101) of a visual target associated workout device comprises of:

Projection means (102),
Support structure (108),
Controller (109),
Storage means (110),
Input means (111),
Wireless means (112),
Power source (113),
Video capturing means (114),
Processing means (115).

Wherein;

Said Projection means (102) is placed on the top of a Support structure (108). Said Projection means (102) facilitates the projection of a visual target and determines the position of the user on the basis of said target.

Referring to FIG. 2, said Projection means (102) further comprises of:

Light source (103)
Sensor (104)
Holder (105)
Motor X (106)
Motor Y (107)

Wherein;

Said Light source (103) is, but not limited to a laser light projector and a video projector. Said light source (103) is connected to sensor (104) on one end and on the other hand, is connected to plurality of motors, Motor X (106) and Motor Y (107). Said Light source (103) projects the plurality of visual targets at different positions for the users. Said visual targets are projected on any surfaces such as, but not limited to ground and/or a floor and therefore, eliminates the need of a projecting screen and/or a wall.

Said sensor (104) is, but not limited to a LIDAR sensor, distance sensitive cameras and a depth camera sensor that always measures the distance between the user and the previously projected visual target as well as the distance between the user with reference to the Support structure (108). Said sensor (104) is connected to the light source (103). Said sensor (104) determines the position of user in real-time during the workout. Said sensor (104) verifies if the user has reached the visual target or not. Said sensor (104) determines the distance travelled by user during the course of workout and the time taken to travel that distance.

Said Holder (105) holds the Light source (103) and the sensor (104) such that the Light source (103) and the sensor (104) are projecting a parallel field of vision and thereby, defines the position of the projection of Light source (103).

Said plurality of motors, Motor X (106) and Motor Y (107) are, but not limited to servo motors or any other motor and/or actuator. Said plurality of motors are connected to power source (113) and configured to facilitate the provision of rotational motion to the Light source (103) along the first axis by Motor X (106) and along the second axis by Motor Y (107).

Said Motor X (106) is directly connected to the sensor (104) and the Controller (109). Said Motor X (106) facilitates the rotational motion of the Light source (103) along a first axis wherein the first axis is orthogonal to the longitudinal axis of the Support structure (108). Said Motor X (106) determines the distance of projection from the light source (103).

Said Motor Y (107) is connected to the sensor (104) and Controller (109). Said Motor Y (107) facilitates the rotational motion of the Light source (103) along a second axis wherein, the second axis is collinear to a longitudinal axis of the Support structure (108). Said Motor Y (107) determines the position of simultaneous target projections.

Said Support structure (108) provides a heighted base to the projection means (102).

Said Controller (109) controls the operations that are, but not limited to interpret if the user has reached the target through the readings of sensor (104) and simultaneously control the rotation of motors to project the next visual target at the desired position. Said Controller (109) is connected to Light source (103) and sensor (104) on one end, and to Motor X (106) and Motor Y (107) on another end.

Said Storage means (110) is connected to the Controller (109). Said storage means (110) is, but not limited to an external SD card and facilitates the storage of the visual target projection information associated with the degrees of rotation of plurality of motors, Motor X (106) and Motor Y (107) to project the visual target at the desired position.

Said input means (111) is connected to the controller (109) through the wireless means (112). Said Input means (111) is a smart device including, but not limited to a smartphone, a tablet, a laptop, or a smart watch. As an alternative, the controller (109) may be connected to the plurality of input means (111) to create a simultaneous to & fro communication and establish synchronized working between plurality of said input means (111). Said Input means (111) provides the communication that is, but not limited to allow the user to communicate with the present device to choose from the preset drills available or to make their own drill. to monitor the heart rate and/or pulse of the user during the course of workout; depending upon the smart device connected. The drills are the methods or instructions of workout where the users can decide the time limit, number of targets or the difficulty level of their workout.

Said Wireless means (112) is, but not limited to a Wi-Fi or a Bluetooth connection and provides a wireless connection to efficiently develop a mode of communication between the Controller (109) and Input means (111).

The present visual target assisted workout device (101) is connected to the Power source (113). Said Power source (113) is but not limited to a lithium ion battery. Said Power source (113) is connected to the Controller (109), Light source (103), sensor (104) and the plurality of motors, Motor X (106) and Motor Y (107).

Said Video capturing means (114) is connected to the Controller (109) and captures the form of the user during the course of the workout. Said Video capturing means (114) is placed in the holder (105).

Said Processing means (115) is connected to the Controller (109) and storage means (110). Said Processing means (115) compares the video captured by the Video capturing means (114) to previously captured videos and ensures the correctness of the form and technique of the user during the workout.

Working of the Invention

The detailed stepwise working of the present invention (101) is explicated herein. The present invention (101)

works simultaneously and parallelly, and thus provides a substantially efficient visual target associated workout device.

Switching on the device: The present visual target assisted workout device has an ON/OFF switch which is used to turn on the device.

When the device is switched on, the power supply (124) turns on the Controller (109) and the power is supplied to other component parts such as light source (103), sensor (104) and plurality of motors (106, 107).

Connecting the input means: After turning on the device, the user connects the Input means (111) to the Controller (109) through wireless means (116). The user then provides inputs through the Input means (111). Said inputs are in the terms of providing name/s of the user/s, selecting the device and the drill which is supposed to be played. Said drills can be selected on the basis of number of targets during the workout, time duration of the workout or the difficulty level of the workout.

Selecting the parameters: The parameters to be selected are pre-fed in the Storage means (110) or it can also be selected as per the choice of user through the input means (111).

After the selection of the drill, the projection means (102) gets signal from the Controller (109) to provide the output. The Light source (103) and sensor (104) gets activated as per the inputs provided through the Input means (111) to the Controller (109).

Projecting the visual target: The Light source (103) projects the visual targets which provide directions to the users. Said visual targets serve as an indicator to the user as to where the user is supposed to reach. Said visual targets are pursued by the users performing the workout.

The light source (103) and the sensor (104) are connected to plurality of motors, Motor X (106) and Motor Y (107) and is held by the holder (105) which defines the position of the light source. The controller (109) provides inputs to said plurality of motors, Motor X (106) to rotate between 0-270 degrees and Motor Y (107) to rotate 0-360 degrees to project at the desired position.

Tracking user's position: Instead of scanning the whole area, the sensor (104) only scans the spot where the Light source (103) is projecting the target as it is the only spot user is supposed to reach. When the user reaches the target, sensor (104) communicates with the plurality of motors, Motor X (106) to rotate between 0-270 degrees and Motor Y (107) to rotate 0-360 degrees to move the holder (105) through inputs from the controller (114) to project the next visual target.

Generating the data: The sensor (104) determines the distance travelled by user during the workout and the time taken to travel that distance. The sensor (104) also determines if the user has reached the target and send inputs to the light source (103) through the controller (109) to project the next visual target.

Transmitting the data: The data regarding the time taken and the time taken to travel their distance is stored in the storage means (110) and is transmitted to the input means (111) through the wireless means (112).

The input means (111) computes the acceleration and velocity of the user during the workout. The faster the user runs towards the visual target, more intense the workout.

Accessing the data: The user access said data through the input means (111) connected to the present device (101).

The Video capturing means (114) when turned on, captures the form of the user during the workout. It analyses the movement of the user that is moving towards the projected target. Said captured videos are then stored in Storage means (110).

Processing means (115) is connected to the Storage means (110) to gain access to the previously captured videos by the video capturing means (114). The captured videos of the user are further compared and analyzed by either the processing means (115) or the input means (111).

Working Examples

TABLE 1

| | Distance travelled | Time taken | Velocity | Stamina |
|---|---|---|---|---|
| User A | 20 Meter | 8 Sec | 2.5 m/s | 7/10 |
| User B | 20 Meter | 10 Sec | 2 m/s | 5/10 |

Selecting the preset drill, User A travelled the distance of 20 meters in 8 seconds whereas, the User B travelled the same distance in 10 seconds. As the velocity of the user A remains constant throughout the workout, the stamina was ranked 7/10. On the other hand, the User B started the workout fast but gradually the velocity decreased due to which the stamina was ranked 5/10. The present invention thus, efficiently and accurately measures the distance travelled by the user during the course of workout and the time taken to travel that distance and thereby, computes the velocity and stamina of the user as mentioned in Table 1.

Advantages of the Invention

The present invention of a visual target associated workout device has multiple advantages over the prior art:

The present invention provides a visual target assisted workout device that can be used either indoors or outdoors.

The present invention provides a visual target associated workout device that projects the visual targets instead of using the physical targets such as cones and/or pods, which gives flexibility in the position of targets and number of drills.

The present invention provides a visual target assisted workout device that determines the position of the user in reference to the light source and thus allows the user to compute the acceleration and velocity during the workout.

The present invention provides a visual target associated workout device that determines the position of the user to provide the next consecutive visual targets and thus, interacts with the user in real-time.

The present invention provides a visual target assisted workout device that analyzes the skills of the user by computing the acceleration, velocity, agility and reflexes of the user during the workout.

The present invention provides a visual target associated workout device that captures the form of the user during the course of the workout and compares it with the previously captured video to check for the correctness of form and technique of the user.

The present invention of a visual target associated workout device provides a user-friendly visual target associated workout device as it is configured to any smart devices.

The present invention of a visual target associated workout device coordinates with the input means to monitors the heart rate and/or the pulse rate of the user during the course of workout and provides with the analytics in accordance to the targets projected.

The present invention of a visual target associated workout device that eliminates the use of additional lenses for target projection and is therefore, cost-efficient.

The present invention of a visual target associated workout device that is compact and portable and can be carried anywhere.

The invention claimed is:

1. A visual target assisted workout device comprising:

a projection means (102) located on top of a support structure (108), configured to project a visual target, and determine a position of a user performing a workout based on said visual target; said support structure (108) forming a base of said projection means (102); wherein said projection means (102) comprises:

a light source (103) connected to a sensor (104), and also connected to a first motor and a second motor and configured to project a plurality of visual targets at varied positions for the user performing the workout to follow as part of the workout, wherein said visual target is displayed on a ground or a floor; said sensor (104) is configured to measure the distance between the user performing the workout and the visual target as well as the distance between the user performing the workout with reference to said support structure (108) in real time, and to verify whether the user performing the workout has reached said visual target in real time and to measure the distance travelled by the user performing the workout during the workout and the time taken to travel said distance, wherein the sensor (104) only scans a spot where the light source (103) is projecting the visual target;

a holder (105) configured to hold said light source (103) and the sensor (104) such that said light source (103) and the sensor (104) project a parallel field of vision and define a projection position of said light source (103);

the first motor and the second motor are connected to said sensor (104) and to a controller (109) which is configured to rotate said light source (103) along a first axis and a second axis respectively and is configured to control the rotation of the first and second motors and project the visual target accordingly;

a storage means (110) connected to the controller (109) is configured to store visual target projection information associated with the degrees of rotation of the first motor and the second motor;

an input means (110) connected to the controller (109) through a wireless means (112) configured to facilitate communication between a user who is controlling the workout and said device (101) through preset drills and to monitor heart rate and pulse in real time during the workout; said wireless means (112) is a wireless connection for communicating to said device (101) through the controller (109) and the input means (111);

a video capturing means (114) inside said holder (105), connected to said controller (109), configured to capture video of the user performing the workout during the course of the workout; and a processing means (115), connected to said controller (109) and said storage means (110), configured to compare video captured by said video capturing means (114) to previously captured videos and ensure the correctness of the form and technique of the user performing the workout during the workout;

wherein, when it is determined that the user performing the workout has reached the visual target, the sensor communicates with the motors and the controller provides inputs to the motors such that the first motor is made to rotate between 0 and 270 degrees and the second motor is made to rotate between 0 to 360 degrees, to move the holder, according to inputs from the controller, to project a next visual target;

wherein the first motor facilitates rotational motion of the light source along the first axis wherein the first axis is orthogonal to the longitudinal axis of the support structure, such that the first motor determines the distance of projection from the light source; and wherein the second motor facilitates rotational motion of the light source along the second axis, wherein the second axis is collinear to a longitudinal axis of the support structure, such that the second motor determines the position of target projections.

2. The device as claimed in claim 1, wherein said sensor (104) is a LiDAR sensor.

3. The device (101) as claimed in claim 1, wherein said first motor and said second motor are servo motors.

4. The device (101) as claimed in claim 1, wherein said input means (111) is a smart device, a smartphone or a tablet or a smart watch or a laptop.

5. The device as claimed in claim 1, wherein said controller (109) is connected to the input means (111) to generate a bi-directional communication simultaneously to establish synchronized working between the input means and the device.

* * * * *